US007438183B2

(12) United States Patent
Focke et al.

(10) Patent No.: US 7,438,183 B2
(45) Date of Patent: Oct. 21, 2008

(54) CIGARETTE PACKAGING

(75) Inventors: Heinz Focke, deceased, late of Verden (DE); by Doris Focke, legal representative, Verden (DE); by Jürgen Focke, legal representative, Verden (DE); Valeri Goncharenko, Kirchlinteln (DE); Henry Buse, Visselhövede (DE)

(73) Assignee: Focke & Co. (GmbH & Co. KG), Verden (DE)

( * ) Notice: Subject to any disclaimer, the term of this patent is extended or adjusted under 35 U.S.C. 154(b) by 456 days.

(21) Appl. No.: 10/525,652

(22) PCT Filed: Aug. 20, 2003

(86) PCT No.: PCT/EP03/09206

§ 371 (c)(1),
(2), (4) Date: Feb. 25, 2005

(87) PCT Pub. No.: WO2004/024596

PCT Pub. Date: Mar. 25, 2004

(65) Prior Publication Data

US 2006/0021883 A1 Feb. 2, 2006

(30) Foreign Application Priority Data

Aug. 26, 2002 (DE) ..... 102 39 681

(51) Int. Cl.
*B65D 85/10* (2006.01)

(52) U.S. Cl. ..... 206/268; 206/273

(58) Field of Classification Search ..... 206/242, 206/259, 265, 268, 271, 273, 459.5, 831; 229/160.1
See application file for complete search history.

(56) References Cited

U.S. PATENT DOCUMENTS

| | | | | |
|---|---|---|---|---|
| 2,929,542 | A | 3/1960 | O'Gorman | |
| 5,788,065 | A | 8/1998 | Focke | |
| 5,826,785 | A * | 10/1998 | Belvederi et al. | 206/273 |
| 5,845,770 | A | 12/1998 | James et al. | |
| 6,138,823 | A * | 10/2000 | Focke et al. | 206/268 |
| 6,505,735 | B1 * | 1/2003 | Parker | 206/268 |
| 7,152,731 | B2 * | 12/2006 | Draghetti et al. | 206/259 |

FOREIGN PATENT DOCUMENTS

| | | |
|---|---|---|
| CN | 1124221 | 6/1996 |
| DE | 1996454 | 7/1968 |
| DE | 91 12 727 U1 | 1/1992 |
| DE | 43 33 462 A1 | 4/1995 |
| DE | 196 43 411 A1 | 4/1998 |
| DE | 905 054 A1 | 3/1999 |
| DE | 197 42 536 A1 | 4/1999 |
| DE | 199 38 196 A1 | 2/2001 |
| EP | 0905054 A1 | 9/1998 |
| EP | 882 658 A1 | 12/1998 |
| EP | 1 140 661 A1 | 10/2001 |

(Continued)

*Primary Examiner*—Luan K Bui
(74) *Attorney, Agent, or Firm*—Sughrue Mion, PLLC

(57) ABSTRACT

The invention relates to a cigarette pack of the hinge-lid type comprising an opening (36) configured in the lower section of the front face, namely in a front wall (12) of the pack. A marking (38), applied to the inner wrapper for identifying the product, is visible through said opening.

6 Claims, 5 Drawing Sheets

FOREIGN PATENT DOCUMENTS

| | | | |
|---|---|---|---|
| EP | 1 174 364 | A1 | 1/2002 |
| JP | 59-188812 | U | 12/1984 |
| JP | 10-211939 | A | 8/1998 |
| JP | 11-157588 | A | 6/1999 |
| WO | WO 02 28744 | A1 | 4/2002 |
| WO | WO 02 28745 | A1 | 4/2002 |

* cited by examiner

CIGARETTE PACKAGING

BACKGROUND OF THE INVENTION

The invention relates to a cigarette pack comprising at least two blanks, namely an inner blank which surrounds a cigarette group preferably on all sides and an (outer) pack blank made of paper, (thin) cardboard or similar material, in particular for the formation of a hinge-lid pack.

Hinge-lid boxes are known by their construction and design as being the most common type of cigarette pack worldwide. A group of cigarettes as the pack's contents is surrounded by an inner blank (inner liner) made of paper, metal-coated paper (tin foil) or similar material to form a cigarette block. The actual pack (embodied as a hinge-lid pack) consists of (thin) cardboard forming a box part and a lid connected thereto. In addition, a collar made from a separate blank forms a part of this pack. The collar is anchored in the box part in the region of its front side and side walls. A hinge-lid pack is usually surrounded by an outer wrapper made of plastic film which is removed by means of a tear-off strip when the pack is used for the first time.

SUMMERY OF THE INVENTION

The object on which the invention is based is to achieve a further development in packs intended as consumer goods, especially cigarette packs in their hinge-lid embodiment, with respect to their outer design, specifically with the aim of achieving improved means of marking or identification.

To solve this object, the pack according to the invention is characterized by the following features:

a) the outer blank is provided with at least one opening in the region of at least one pack wall, b) the inner blank has at least one printed and/or embossed area which in the finished pack lies at least partially in the region of the opening and which is visible through said opening.

The invention is based on the knowledge that pack blanks, in particular the typical blanks of a hinge-lid pack, are industrially pre-fabricated, also with respect to their exterior printed design, and usually delivered in stacks of blanks for processing in a packaging machine.

This makes it impossible to implement any further changes to the design in the region of the packaging machine or associated equipment.

In contrast, the packaging material for the inner wrapper, in particular tin foil, can be provided with a label, emblem, insignia or the like by means of printing or embossing in the region of the packaging machine, in particular by the appropriate embossing of the material. This particular element is positioned in the region of the opening, thus remaining visible even when the pack is closed.

The opening is placed preferably in the region of a front wall of the pack, in particular at a (lower) box front wall of a hinge-lid pack, with the printed or embossed area being correspondingly located in the region of an inner front wall of the inner blank. One special feature consists of placing the opening in the region of an in particular enlarged collar, with the collar and box front wall having openings which correspond to one another, preferably with a different geometric design.

BRIEF DESCRIPTION OF THE DRAWING

Further details of the inventions will be described below in more detail on the basis of exemplary embodiments featured in the illustrations, which show.

DETAILED DESCRIPTION OF THE INVENTION

Figure 2:
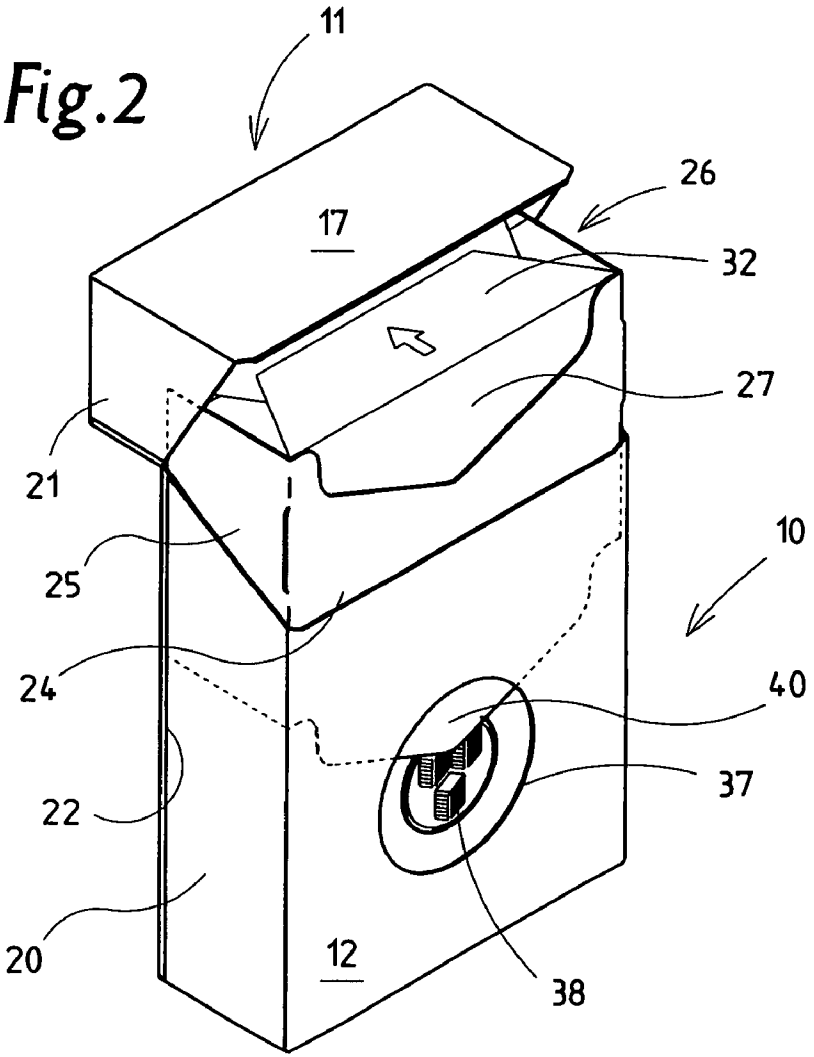
FIG. 2 another exemplary embodiment of a hinge-lid box in a view corresponding to FIG. 1, FIG. 3 a spread-out pack blank for a hinge-lid box pursuant to FIG. 1, FIG. 4 a blank for a hinge-lid box pursuant to FIG. 1, FIG. 5 a blank for a hinge-lid pack pursuant to FIG. 2, FIG. 6 a collar for a hinge lid box pursuant to FIG. 2, FIG. 7 a spread-out inner blank, FIG. 8 another exemplary embodiment of a hinge-lid box in a view corresponding to FIG. 1, FIG. 9 a hinge-lid box pursuant to FIG. 1, FIG. 2 or FIG. 8 in the closed position with an outer wrapper of plastic film.

The exemplary embodiments shown in the drawings relate to hinge-lid boxes for cigarettes. This type of pack comprises a (lower) box part 10 and lid 11. The pack parts consist of a common, single-piece blank pursuant to FIG. 3. The elongate blank forms successive regions for a box front wall 12, base wall 13, box rear wall 14, lid rear wall 15, end wall 16 and lid front wall 17. Connected to the latter is a lid inner tab 18, which is folded against the inner side of the lid front wall 17. Box rear wall 14 and lid rear wall 15 are connected to each other by a line hinge 19. Box side walls 20 and lid side walls 21 are comprised of side tabs 22, 23, which overlap each other at least partially and which are connected to each other by adhesive bonding.

Figure 4:
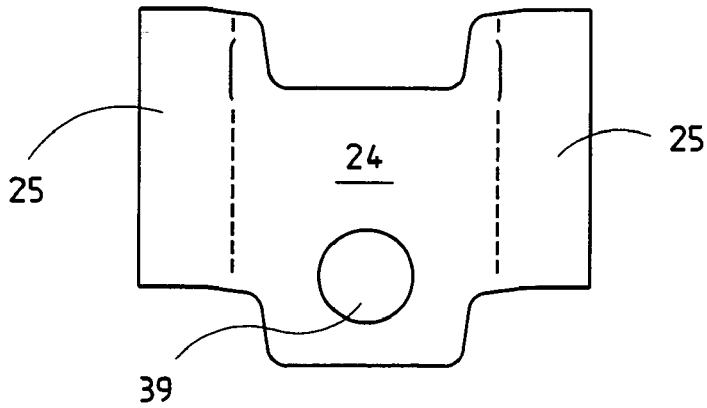
Figure 6:
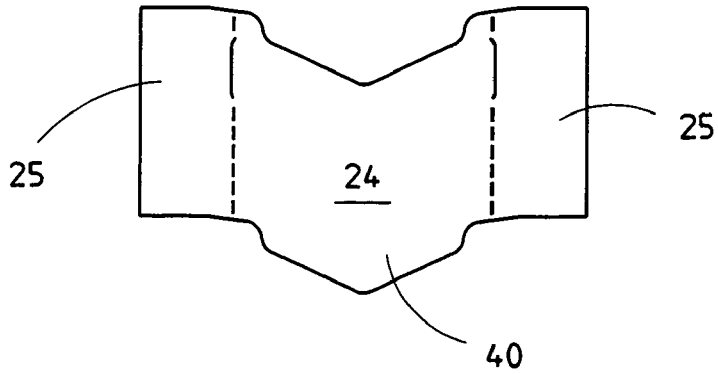

A hinge-lid pack also includes a collar made from a separate blank (FIG. 4, FIG. 6). The collar comprises a collar front wall 24 and lateral collar tabs 25. The collar is positioned within the box part 10, with the collar front wall 24 lying on the inner side of the box front wall 12 and connected thereto (by adhesive bonding). An upper part of the collar projects from the box part 10 and is surrounded by the latter when the lid 11 is in its closed position.

Figure 7:
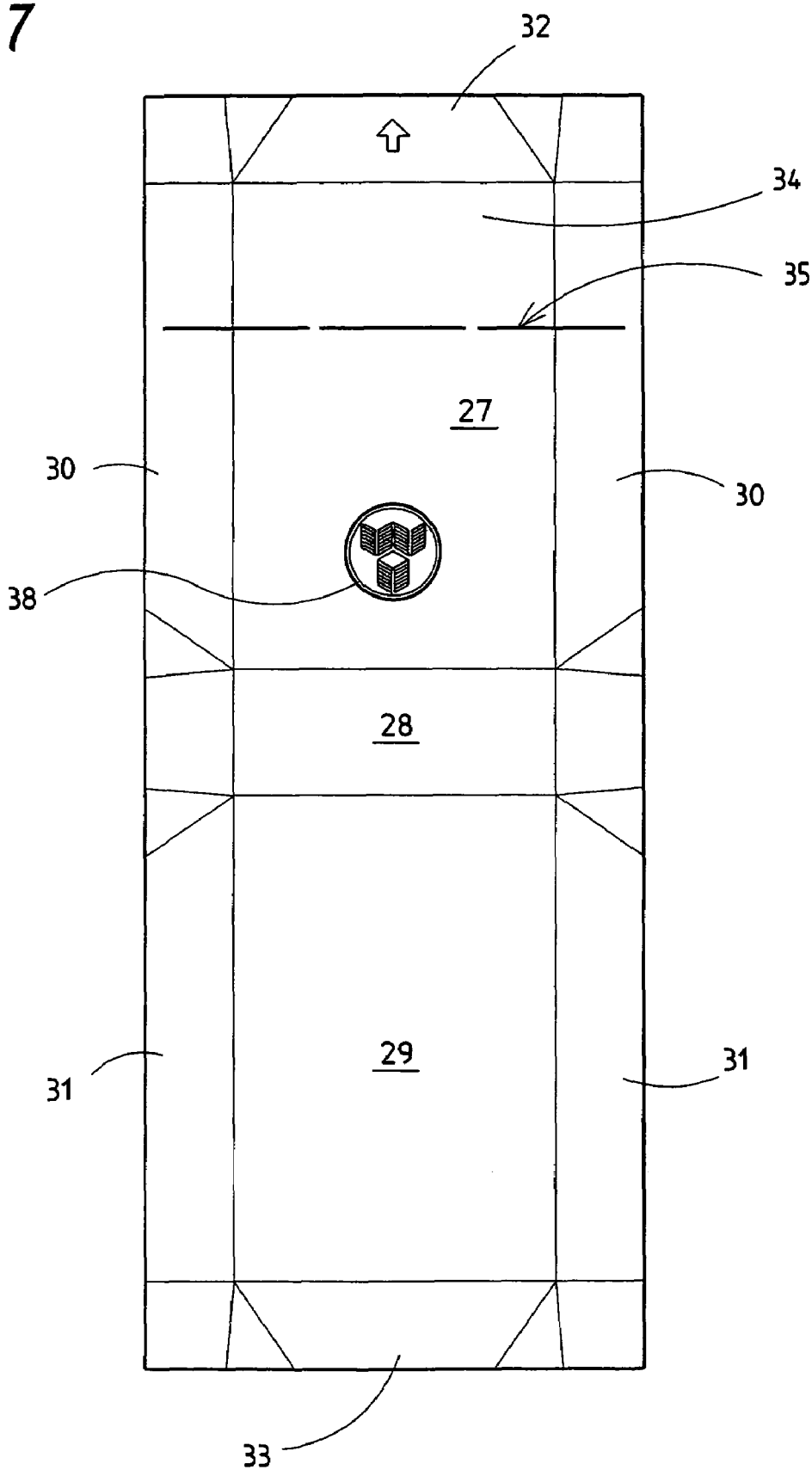

The contents of a pack, i.e. a cigarette group, is surrounded by an inner blank (FIG. 7) made of paper or tin foil, i.e. metal-coated paper. The inner blank completely surrounds the pack contents, thus forming a cigarette block 26 with connecting regions of an inner front wall 27, an inner base wall 28 and an inner rear wall 29. Also present are lateral folding tabs 30, 31 which, by means of corresponding folding and partial overlapping, form side walls in the finished cigarette block 26.

Accordingly, end tabs 32, 33 are provided which form a folded upper inner end wall. As usual, an upper part of the inner blank is configured on its front side as a detachable tab or flap 34. This is delimited from the remaining part of the inner blank by a transverse perforation line. 35. The flap 34 is severed by the user's gripping of the outer end tab 32 when opening the pack for the first time.

At least one pack wall is provided with an opening 36, 37. This opening 36, 37 is preferably placed in the region of the box front wall 12. The opening 36, 37 exposes a corresponding surface area of the inner blank, namely the inner front wall 27. Accordingly, this is visible from the outside in the region of the opening 36, 37.

Figure 8:
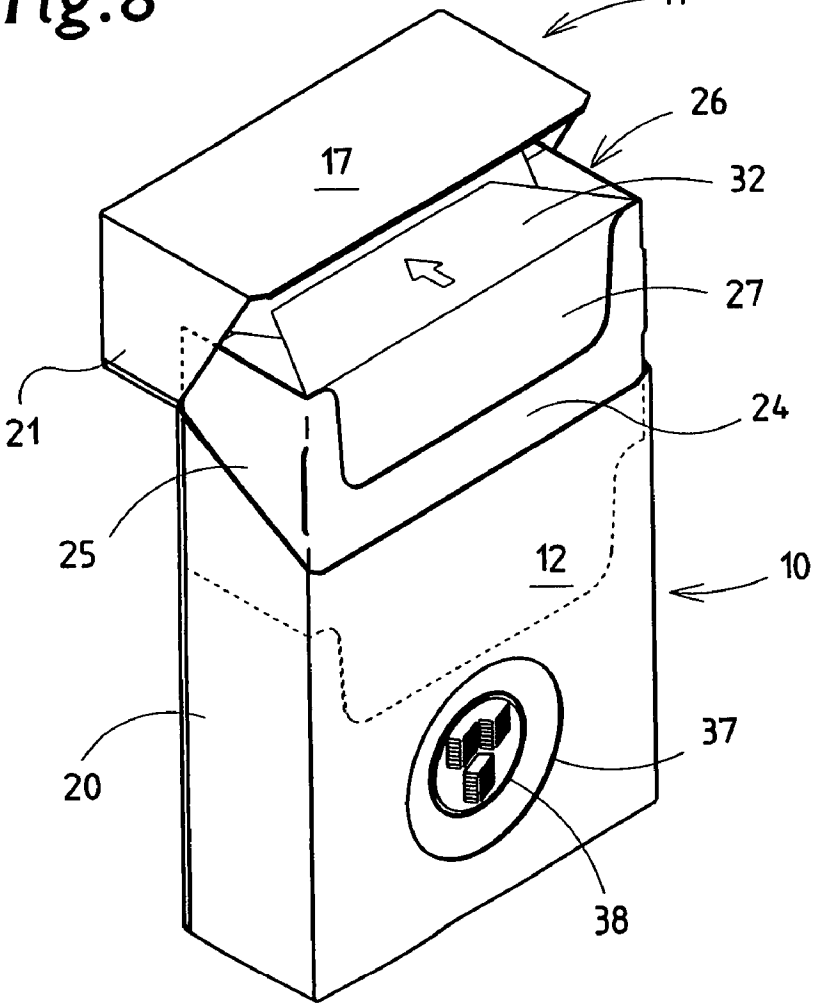

The openings 36, 37, which are formed by punching, can assume various geometric shapes, e.g. form a triangle (FIG. 1) or a circular area (FIG. 2, FIG. 8). Other, even complex geometric shapes of the openings 36, 37 are also suitable.

In the region of the opening 36, 37, the inner blank is provided with a marking 38. This can take the form of a label, mark or logo. But it can also provide information or data for pack identification with respect to origin, place and date of manufacture. For an inner blank made of tin foil, the marking 38 is an embossing. This is preferably applied during the preparation of the packaging material for the inner blank, namely in the region of embossing rollers during the usual processing of a web of packaging material. For this purpose, the embossing rollers can be configured such that a circumferential part for embossing the marking 38 can be easily interchangeable in order to make a quick change in the marking 38 possible. For an inner liner of paper or similar material, the marker 38 is expediently applied by printing, likewise in the region of the packaging machine. The marking 38 is applied such that is appears approximately at the center of the opening 36, 37.

The collar is adapted to the shape and position of the opening 36, 37. In the exemplary embodiment according to FIG. 1, the collar, in particular collar front wall 24, extends to a lower region of the box front wall 12, namely to the base wall 13 or to the vicinity of the base wall 13. The opening 36 is completely situated in the region of the collar front wall 24. The latter is provided with a collar opening 39. This can have the same geometric shape as the opening 36, 37. Expediently, the collar openings 39 assume a circular shape, specifically with dimensions (diameter) that are slightly smaller than the openings 36, 37. The collar openings 39 are positioned such that, when the specified relative position of the collar is assumed in the pack or in the box part, the collar opening 29 is situated at least partially, but preferably approximately centered in the region of the opening 36 or 37. The marking 38 applied to the inner wrapper is accordingly visible from the outside through the two punched-out areas, namely the opening 36, 37 on one hand, and the collar opening 39 on the other.

Figure 1:
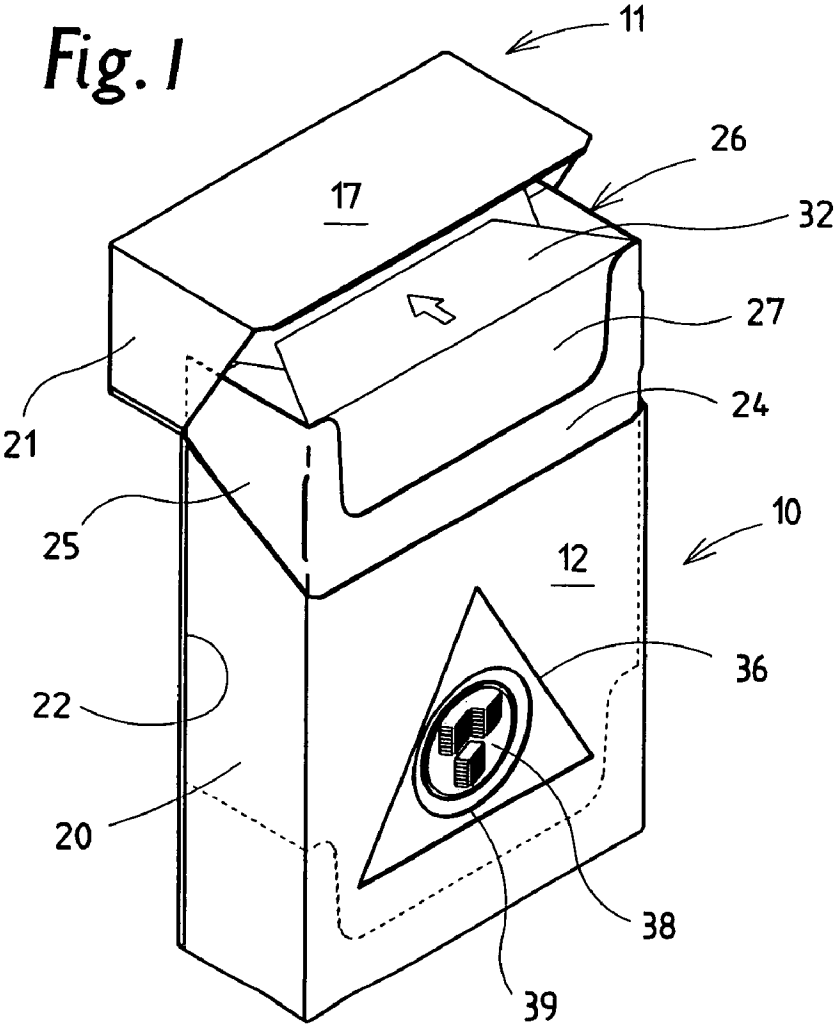
FIG. 1 a perspective view of a hinge-lid pack with open lid.
Figure 3:
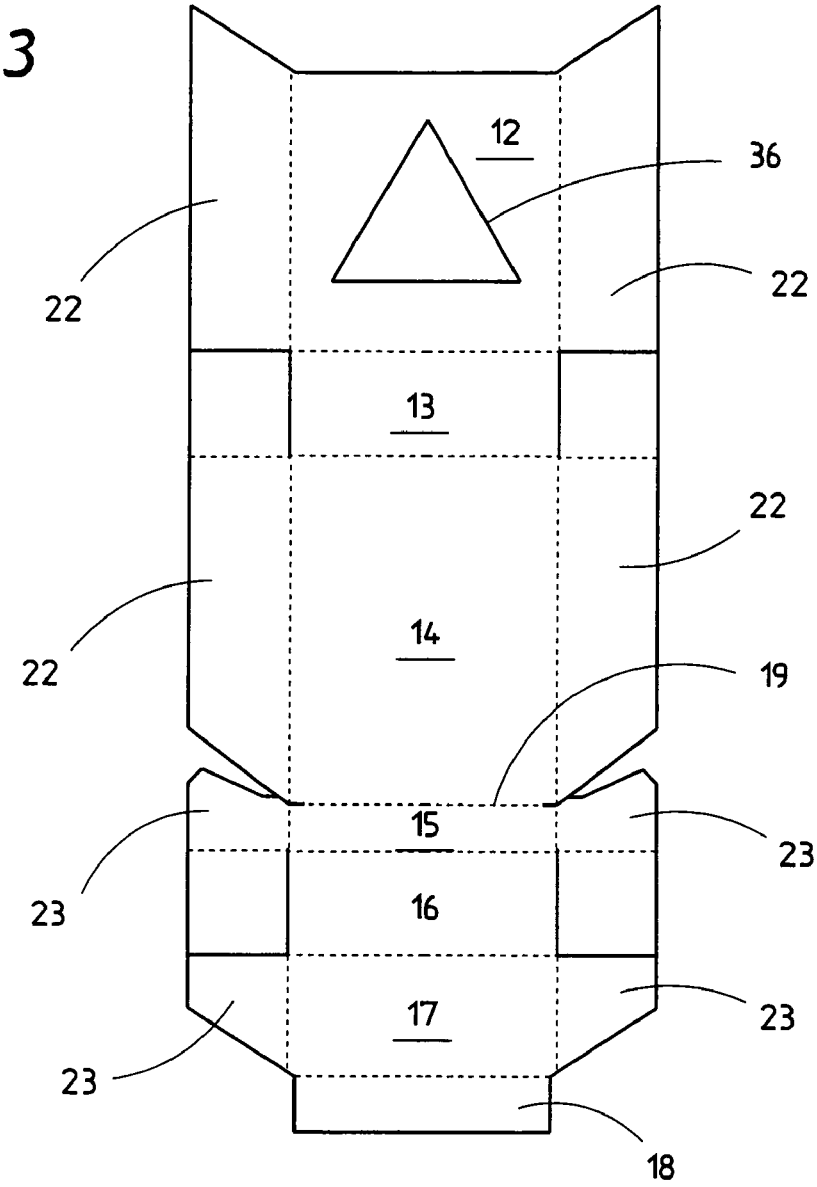

In the exemplary embodiment according to FIG. 1, FIG. 3 and FIG. 4, the opening 36 in the box front wall 12 is configured as a (equilateral) triangle. The collar opening 39 is configured as a circular area, in particular concentric to the (likewise) circular-shaped marking 38 and disposed in the lower region of the enlarged, or lengthened, collar front wall 24 in such a manner that the collar opening 29 lies completely and approximately centered within the opening 36.

Figure 5:
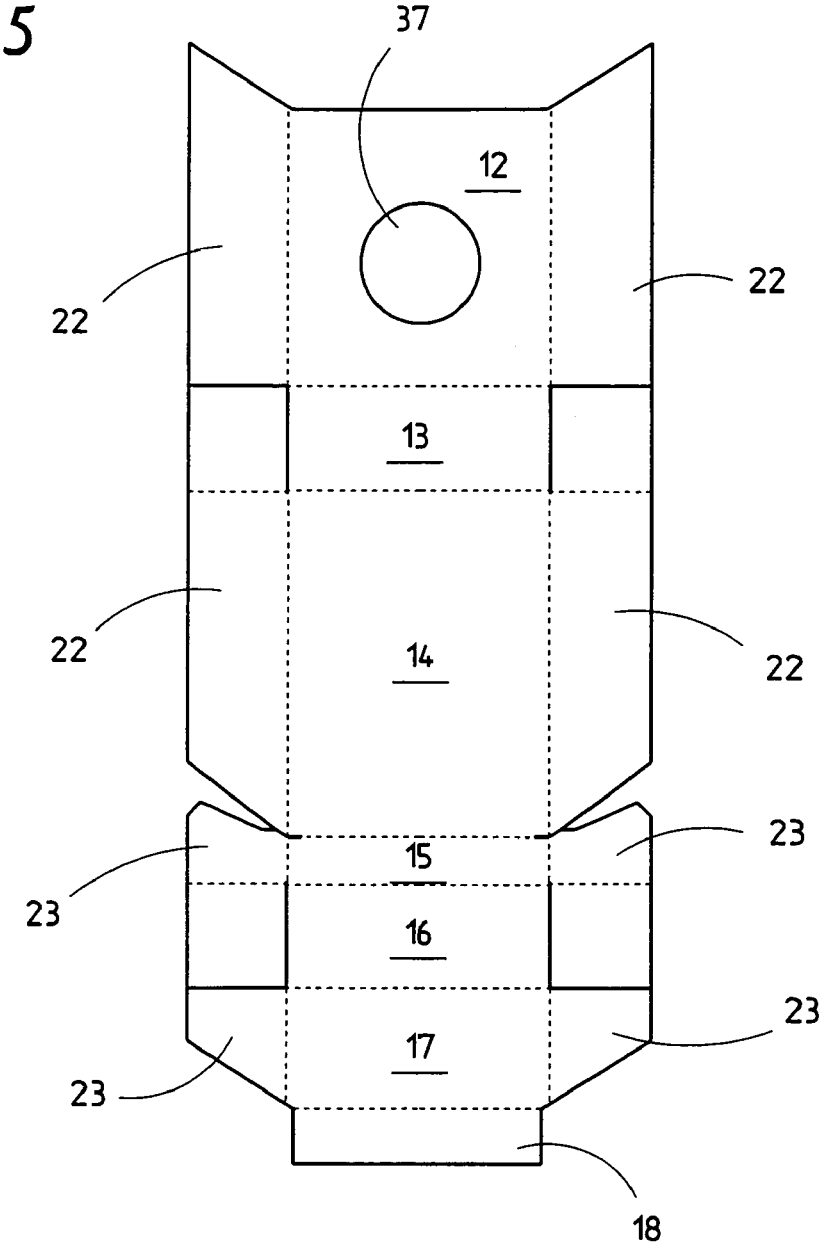

In the exemplary embodiment pursuant to FIG. 2, FIG. 5 and FIG. 6, the collar (FIG. 6) is provided with a V-shaped protrusion 40 at the lower marginal region of the collar front wall 24. Due to the predetermined relative position of the collar and its dimensions, a portion of said protrusion 40 projects into the opening 37 (FIG. 2). This part of the collar, or collar front wall 24, is therefore visible in the opening 37. The relative position here has been selected so that the protrusion 40 also covers a portion of the marking 28.

Figure 9:
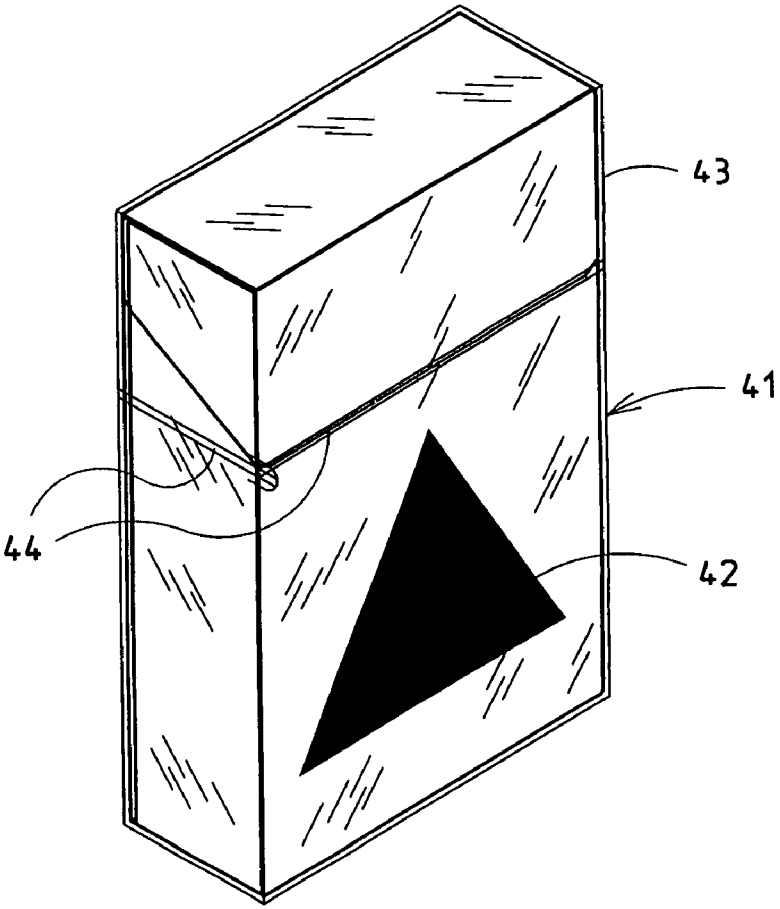

Another special feature is realized in the exemplary embodiment pursuant to FIG. 8, FIG. 9. Here the opening 37 is positioned in the lower region of the box front wall 12, and in any case completely below the collar and collar front wall 24. The special feature here is that the opening 37 and marking 38 are covered until the pack is used for the first time, so that the consumer discovers the marking 38 upon opening the pack and can thereby assign its relevance to the pack. To this end, an outer wrapper 41 is provided, especially one made of plastic film. This outer wrapper 41 of transparent film commonly used for such a pack is provided in the region of the opening 37 or at least in the region of the marking 38 with a cover layer 42 which hides the marking 38 from view until the outer wrapper 41 is removed. The cover layer 42 can be a layer of colored coating or an adhesive label attached to the inside of the wrapper.

The combination of an opening in the pack, on one hand, and a marking on the inner wrapper, on the other hand, can also be positioned at another part of the pack, e.g. in the region of the lid 11. In the embodiment pursuant to FIG. 9 with its partially masked outer wrapper 41, the cover layer 42 is positioned in the region of the lid 11, i.e. in the region of a film cap 43, which is severed from the outer wrapper when the pack is opened for the first time with a tear-open strip 44.

The openings 36, 37 are expediently created by punching operations during the fabrication of the blanks, specifically in a common work cycle with the punching of the blanks themselves.

LIST OF DESIGNATIONS

10 box part
11 lid
12 box front wall
13 base wall
14 box rear wall
15 lid rear wall
16 end wall
17 lid front wall
18 lid inner tab
19 line hinge
20 box side wall
21 lid side wall
22 side tab
23 side tab
24 collar front wall
25 collar tab
26 cigarette block
27 inner front wall
28 inner base wall
29 inner rear wall
30 folding tab
31 folding tab
32 end tab
33 end tab
34 flap
35 perforations line
36 opening
37 opening
38 marking
39 collar opening
40 protrusion
41 outer wrapper
42 cover layer
43 film cap
44 tear-off strip

The invention claimed is:

1. A cigarette pack comprising at least two blanks, namely an inner blank, which is made of tin foil or paper and which surrounds a cigarette group on all sides, and a pack blank which is made of thin cardboard and which, by formation of a box part (10) and a lid (11), surrounds the cigarette group arranged in the inner blank as pack contents, characterized by the following features:

the pack blank is provided with at least one opening (36, 37) in a region of at least one pack wall, the inner blank has at least one printed or embossed marking (38) which in a finished pack lies at least partially in a region of the opening (36, 37), and which is visible from outside the pack, the box part (10) has a box front wall (12), the opening (36, 37) is in a region oft e box front wall (10), the marking (38) on the inner blank is located on an inner front wall (27) of the inner blank in the region of the opening (36, 37), arranged in the box part (10) is a collar with a collar front wall (24) at the inner side of the box front wall (12), and the collar front wall (24) projects with a downward-pointed protrusion (40) into the opening (37) of the box front wall (12) such that the marking (38) on the inner blank is visible from outside the pack.

2. A cigarette pack comprising at least two blanks, namely an inner blank, which is made of tin foil or paper and which surrounds a cigarette group on all sides, and a blank pack which is made of thin cardboard and which, by formation of a box part (10) and a lid (11), surrounds the cigarette group arranged in the inner blank as pack contents, characterized by the following features:

the pack blank provided with at lea one opening (36,37) in a region of at least one pack wall, the inner blank has at least one printed or embossed marking (38) which in a finished pack lies at least partially in a region of the opening (36, 37), and which is visible from outside the pack, the box part (10) has a box front wall (12), the opening (36, 37) is in a region of the box front wall (10), the marking (38) on the inner blank is located on an inner front wall (27) of the inner blank in the region of the opening (36,37), arranged in the box part (10) is a collar with a collar front wall (24) abutting the inner side of the box front wall (12), the opening (37) is located in a region of the box front wall (12) of the box part (10), the collar front wall (24) extends across a full surface area or full dimension of the opening (36) of the box front wall (12), the collar front wall (24) is provided with a collar opening (39) in the region of the opening (36, 37) of the box front wall (12), and the marking (38) on the inner blank is located at least partially in a region of the collar opening (39).

3. The pack according to claim 2, characterized by the following features:

a) the collar opening (39) is smaller than the opening (36, 37) in the region of the box front wall (12), b) the collar opening (39) lies completely within the region of the opening (36, 37) in the box front wall (12), and c) the marking (38) is situated completely in the collar opening (39).

4. A cigarette pack comprising at least two blanks, namely an inner blank, which is made of tin foil or paper and which surrounds a cigarette group on all sides, and a pack blank which is made of thin cardboard and which, by the formation of a box part (10) and a lid (11), surrounds the cigarette group wrapped in the inner blank as pack contents, said pack having an outer wrapper (41) made of plastic film, characterized by the following features:

a) the pack blank forms a lower box part (10) and a lid (11) connected thereto, b) the pack contents, namely a cigarette group, is completely surrounded by an inner blank of paper or tin foil to form a cigarette block (26), c) arranged in the box part (10) is a collar with a collar front wall (24) which abuts the inner side of a box front wall (12) of the box part (10) and has lateral collar tabs (25), d) in a region of the box front wall (12), the box part (10) is provided with an approximately centered opening (36, 37), e) the collar front wall (24) extends to a point below the opening (36, 37) so that the opening lies completely in a region of the collar front wall (24), f) the collar front wall (24) is provided with a collar opening (39), g) the collar opening (39) is smaller than the opening (36, 37) of the box front wall (12) and lies completely within a region of the opening (36, 37) of the box front wall (12), h) in a region of an inner front wall (27), of the inner blank is an embossed or printed marking (38), and i) the marking (38) is situated completely within the collar opening (39).

5. The pack according to claim 4, characterized in that that the box front wall opening (36, 37) and the collar opening (39), are configured in the shape of a triangle, square, rectangle or circle.

6. The pack according to claim 5, characterized in that the opening (36) of the box front wall (12), and the collar opening (39), have different geometric shapes.

* * * * *